US011903497B2

(12) United States Patent
Nilsson

(10) Patent No.: US 11,903,497 B2
(45) Date of Patent: Feb. 20, 2024

(54) PRESSING DEVICE FOR APPLYING A COMPRESSIVE FORCE TO PRODUCTS OF A PRODUCT DISPLAY DEVICE, SHELF UNIT AND PRODUCT DISPLAY DEVICE

(71) Applicant: Rickard Nilsson, Balduinstein (DE)

(72) Inventor: Rickard Nilsson, Balduinstein (DE)

( * ) Notice: Subject to any disclaimer, the term of this patent is extended or adjusted under 35 U.S.C. 154(b) by 379 days.

(21) Appl. No.: 17/268,331

(22) PCT Filed: Aug. 19, 2019

(86) PCT No.: PCT/DE2019/100743

§ 371 (c)(1),
(2) Date: Feb. 12, 2021

(87) PCT Pub. No.: WO2020/035116

PCT Pub. Date: Feb. 20, 2020

(65) Prior Publication Data

US 2021/0321792 A1 Oct. 21, 2021

(30) Foreign Application Priority Data

Aug. 17, 2018 (DE) ..... 10 2018 120 136.2

(51) Int. Cl.

| | |
|---|---|
| ***A47F 1/12*** | (2006.01) |
| ***A47F 5/00*** | (2006.01) |
| ***A47F 5/16*** | (2006.01) |

(52) U.S. Cl.

CPC ..... *A47F 1/125* (2013.01); *A47F 5/005* (2013.01); *A47F 5/16* (2013.01); *A47F 2005/165* (2013.01)

(58) Field of Classification Search

CPC .. A47F 1/125; A47F 1/126; A47F 5/16; A47F 2005/165; A47F 5/005; A47B 73/00; A47B 73/006

See application file for complete search history.

(56) References Cited

U.S. PATENT DOCUMENTS

| | | | | |
|---|---|---|---|---|
| 3,780,873 A | | 12/1973 | Silva | |
| 4,351,439 A | * | 9/1982 | Taylor | A47F 1/126 211/59.3 |
| 6,234,328 B1 | * | 5/2001 | Mason | A47F 5/0037 248/242 |
| 6,471,333 B1 | * | 10/2002 | Powell | B41J 2/175 347/49 |
| 6,502,711 B1 | * | 1/2003 | McRae | B65D 75/42 211/74 |

(Continued)

FOREIGN PATENT DOCUMENTS

| | | |
|---|---|---|
| DE | 202013006274 U1 | 7/2013 |
| DE | 102014101755 A1 | 8/2015 |

(Continued)

*Primary Examiner* — Devin K Barnett
(74) *Attorney, Agent, or Firm* — Smartpat PLC

(57) ABSTRACT

A pressing device for applying a compressive force to products of a product display device includes a pressing part for transmitting the compressive force. The pressing device has a mass body with a predefined mass. The pressing device includes a support part carrying the mass body, which is movably connected to an inclined surface carrying the products. An assembly comprises a shelf element having a set-down surface for products, and a pressing device for applying a compressive force against the products.

10 Claims, 8 Drawing Sheets

(56) References Cited

U.S. PATENT DOCUMENTS 7,410,289 B2 * 8/2008 Hill ..... G04B 5/00 81/7.5
7,452,063 B2 * 11/2008 Harada ..... B41J 2/1752 347/85
7,497,342 B2 * 3/2009 Hardy ..... A47F 1/126 211/151
7,500,571 B2 * 3/2009 Hawkinson ..... A47F 1/126 211/59.3
9,138,075 B2 * 9/2015 Hardy ..... A47F 5/0068
9,226,597 B2 * 1/2016 Hardy ..... A47F 1/125
11,084,629 B1 * 8/2021 Kleyman ..... B65D 35/28
2003/0102339 A1 * 6/2003 Walsh ..... B44D 3/127 222/567
2005/0077259 A1 * 4/2005 Menz ..... A47F 1/125 211/59.3
2007/0175845 A1 * 8/2007 Hardy ..... A47F 1/126 211/184
2007/0210093 A1 * 9/2007 Pinelli ..... B65D 43/20 220/715
2008/0217340 A1 * 9/2008 Jager ..... B65D 21/0204 220/524
2009/0200261 A1 * 8/2009 Sasaki ..... B65D 23/106 215/396
2009/0288965 A1 * 11/2009 Greenberg ..... B65D 81/3211 206/222
2010/0006220 A1 * 1/2010 Parhar ..... C08J 5/125 524/285
2010/0104791 A1 * 4/2010 Baudrion ..... C09J 7/22 428/339
2011/0276088 A1 * 11/2011 Thomas ..... C09J 129/04 606/214
2012/0118840 A1 * 5/2012 Howley ..... A47F 1/126 211/59.3
2013/0026117 A1 * 1/2013 Hardy ..... A47B 73/006 211/59.3
2014/0217042 A1 * 8/2014 Hardy ..... A47F 7/0014 29/428
2014/0284290 A1 * 9/2014 Hardy ..... A47F 5/005 211/59.3
2015/0129521 A1 5/2015 Sun
2015/0320237 A1 * 11/2015 Hardy ..... A47F 5/005 211/59.3
2016/0255800 A1 * 9/2016 Powell, III ..... B26D 7/0608
2017/0217634 A1 * 8/2017 Hendrickson ..... B65D 21/0231
2018/0105332 A1 * 4/2018 Ohkubo ..... B65D 75/5883
2018/0127150 A1 * 5/2018 Adanur ..... B65D 21/0215
2018/0140113 A1 * 5/2018 Hardy ..... A47F 1/125
2018/0155090 A1 * 6/2018 Kleyman ..... B65D 35/28
2018/0224202 A1 * 8/2018 Davis ..... A47B 71/00
2018/0296443 A1 * 10/2018 Roehrig ..... A61J 11/008
2018/0360235 A1 * 12/2018 Hardy ..... A47B 65/15
2019/0357701 A1 * 11/2019 Wills ..... A47F 1/125
2020/0000245 A1 * 1/2020 Hardy ..... A47F 5/0068
2020/0205584 A1 * 7/2020 Hardy ..... A47F 1/126
2020/0281847 A1 * 9/2020 Linn ..... A61K 9/006
2020/0397152 A1 * 12/2020 Hardy ..... A47F 7/0014
2021/0321793 A1 * 10/2021 Hardy ..... A47B 87/0223
2023/0211228 A1 * 7/2023 Spiridonovs ..... A63F 1/14 273/149 R

FOREIGN PATENT DOCUMENTS

DE 202016104354 U1 8/2016
DE 202017106827 U1 5/2018

* cited by examiner

PRESSING DEVICE FOR APPLYING A COMPRESSIVE FORCE TO PRODUCTS OF A PRODUCT DISPLAY DEVICE, SHELF UNIT AND PRODUCT DISPLAY DEVICE

TECHNICAL FIELD

The disclosure relates to a pressing device for applying a compressive force to products of a product display device. The invention further relates to a shelf unit and a product display device.

BACKGROUND

In product display devices, such as shelves, products of the same type are often placed in a row one behind the other on shelves. In order to avoid gaps in the row when one or more of the products are removed, the row of products is usually clamped between a product stopper and a pressing device applying a compressive force. The product stopper is usually located at the front area of the shelf and held stationary there, whereas the pressing device can be moved along the shelf and presses on the product of the row located at the back. If one or more of the products are then removed from the row, for example because a customer wants to buy the one or more products, the resulting gap in the row is closed through the sliding of the products at the back. The sliding is automatic due to the compressive force applied by the pressing device.

One possible design method of the pressing device uses its net weight to generate the compressive force. For this purpose, the shelf is to be arranged in an inclined position, for example by the front end of the shelf with the product stopper being lower than the rear end with the pressing device. A pressing device constructed according to this design principle is described in DE 10 2014 101 755 A1. Such pressing device uses the net weight of a roller body, which rolls on the shelf, in order to cause a sliding of products via the pressing device. The pressing device is placed on the shelf and is held in a track, for example, by product separators, which are arranged laterally to the products placed in a row.

SUMMARY

It is an object of the disclosure to provide at least one alternative design of a pressing device of the type mentioned at the beginning. Furthermore, a shelf unit and a product display device, which are suitable for use with such a pressing device, are disclosed.

A basic pressing device for applying a compressive force against products of a product display device comprises, for example, a pressing part for transmitting the compressive force to the products. Further, the pressing device comprises a mass body having a predetermined mass for applying a defined weight force by which the compressive force is effected.

In one embodiment, the pressing device comprises a support part carrying the mass body and/or the pressing part, which support part is configured to be movably connected to an inclined surface carrying the products, in order to allow the movement of the pressing device, in particular of the pressing part and/or the mass body, along the inclined surface. For example, this gives the support part a multiple function. On the one hand, it performs a support function with respect to the mass body and/or the pressing part. On the other hand, the support part serves to perform a connection function with respect to the inclined surface, wherein the support part enables a movable connection with the inclined surface or a component comprising the inclined surface. By means of the movable connection, a prerequisite is created via the support part for applying a compressive force on the products from the net weight of the pressing device, in particular from the weight force caused by the mass body.

With an additional embodiment, it is provided that the mass body comprises or is formed from a base body and the base body is provided with at least one cavity, in which a predetermined quantity of a pourable and/or flowable material is filled in order to generate a or the defined weight force. Thus, a measure is taken to bring the weight of the mass body to the desired target value in a simple manner. By using the pourable or flowable material for this purpose, a dosage with regard to the quantity to be filled in is preferred. A pourable and/or flowable material is understood in particular as such a material that is present in a pourable and/or flowable state at least at the time of filling into the cavity.

For example, the material filled into the cavity of the base body is sandy. Alternatively, it can be provided that the material filled in the cavity of the base body is a liquid. The filled material can also contain or consist of a liquid and a sand. The material that is filled can be such a material that is commercially available and/or available in relatively large quantities, making it relatively inexpensive, for example. This is the case, for example, if the material is or has a quartz sand or tap water.

According to one embodiment, the base body comprises a filling opening that forms an inlet to the cavity. This facilitates the filling and/or emptying of the cavity of the base body. For example, the filling opening enables the refilling of the pourable and/or flowable material along with, for example, the later removal of, for example, a partial quantity of the pourable and/or flowable material. It is thus possible to adjust the weight of the base body or the mass body, as the case may be, to a different value by refilling or removing a certain quantity of the pourable and/or flowable material. In particular, the filling opening is arranged in an upper region of the base body. This prevents the material from escaping from the inclined surface when the pressing device is in the erected state. For example, the filling opening is arranged opposite to the support part on the base body.

According to one design, in order to prevent the material from escaping via the filling opening, a cover element is provided, by means of which the filling opening is closed or can be closed. For example, the cover element is mounted to the filling opening and preferably completely closes the filling opening. The cover element can be a screw cover. In a corresponding manner, the filling opening, in particular the rim of the filling opening, is formed as a screw rim. Also, the cover element can be a clamping cover. In a corresponding manner, the filling opening, in particular the rim of the filling opening, is formed as a clamping rim. The cover element can consist of or comprise a metal. Moreover, the cover element can comprise or consist of a plastic material.

It can be provided that the cavity comprises a seal in order to hold the filled material in the cavity, in particular to fix it in the cavity. Thereby, any redistribution of the material in the cavity can be counteracted. The seal can be a sealing layer that is applied to the material, thereby providing a final layer over the filled material. For example, the sealing layer is a wax layer.

According to one embodiment, it is provided that the base body is a preferably dimensionally stable container, in particular a commercially available container. This favors a low-cost production of the pressing device, since containers already used for other applications can be used. Such a container can be a bottle, a can, a bucket or a canister. The container can be capless or fitted with a cap. The cap can be made of metal or include metal. Also, the cap can comprise or consist of plastic. For example, the base body is a transport packaging or a transport container, as the case may be, for low-viscosity filling materials, such as paints.

According to an additional or different embodiment, the mass body comprises a preferably casted base body that is formed from, for example, a solidified concrete material or comprises such a material. In particular, the concrete material is to be used to achieve, and in particular to adjust, the predefined mass of the mass body, in order to generate the defined weight force. In particular, the solidified concrete material is cured concrete material. The concrete material makes it possible to manufacture the mass body in a technically simple and cost-effective manner.

In the present description, the term "concrete material" is to be understood in particular as a material that comprises at least one binder and at least one aggregate and which has been mixed, for example with the addition of liquid, together with the at least one binder and the at least one aggregate. In particular, the concrete material is substantially dried or completely dried material. The concrete material can be a concrete that is used, for example, as a building material for erecting structures or buildings.

In particular, it is provided that the concrete material comprises a cement and a coarse aggregate. For example, the cement serves as a binder and the coarse aggregate as an aggregate. For example, the aggregate is a sand-like material, such as quartz sand. The cement and/or the coarse aggregate are mass products that are used in large quantities in the construction sector and are therefore available at low cost.

It is further particularly provided that the cement is present over the coarse aggregate in a quantity ratio of between 1:2 and 1:4. For example, the quantity ratio is 1:3 or essentially 1:3. When indicating the quantity ratio, the first figure refers to the proportion of cement and the second figure refers to the proportion of coarse aggregate in the quantity. Practical tests have shown that the concrete material, which has such a quantity ratio of the cement to the coarse aggregate, meets the requirements that have been set in terms of strength and long-term durability, even when used for shelves in refrigerated or frozen areas.

According to an additional embodiment, the base body is surface-treated in order to prevent moisture or other foreign substances from entering. It is to be achieved by the surface treatment that the base body is hydrophobic at its surface or has a hydrophobic protective layer, which can be achieved for example by sealing.

It can also be provided that the mass body has an impregnation partially or completely surrounding the base body, by means of which the penetration of moisture or other foreign substances into the base body is prevented and, furthermore, the surface of the base body remains open to diffusion. By keeping the surface of the base body open to diffusion, any residual moisture can still escape to the environment, for example if the base body is manufactured by casting, for example using the concrete material described above. At the same time, the impregnation counteracts the formation of mold, since the surface can be hydrophobic on the basis of the impregnation, for example.

Suitable impregnation materials are, for example, impregnations containing silicates. It has been shown that such impregnations have favorable properties in order to obtain the intended effect on the surface of the base body. The impregnation can be applied to the base body by dipping and/or spraying.

The surface treatment can give the base body a pigmentation. This makes it possible for the base body to acquire a color design that differs from the original color of the base body.

In an additional embodiment, the support part is fastened to the base body. For example, the support part is fastened to the base body by means of adhesive bonding. A double-sided adhesive tape can be used for this purpose. Such measure is also aimed at realizing the pressing device as cost-effectively as possible. For example, the support part has a contact surface via which the support part is fastened to the base body, in particular the base of the base body.

For example, an adhesive is used. For example, the contact surface and a counter-contact surface of the mass body and/or the base body are formed as an adhesive surface, and the support part and the mass body and/or the base body are fastened against one another thereover by means of the adhesive. For example, the adhesive is a single component plastic adhesive. This measure also aims to enable a cost-effective and, in particular, permanently durable connection between the support part and the base body.

The support part can be a plastic part, in particular it can consist of a plastic or plastic material or comprise a plastic or plastic material. For example, the support part is made in one piece, in particular made in one unit and/or formed in one piece. In principle, the support part can also be molded onto the base body.

With an additional embodiment, the support part is configured to perform a translational movement along the inclined surface. Thus, a form of movement is realized, which can be realized in a technically simple way. For example, the translational movement can be achieved by a sliding motion of the support part relative to the inclined surface, in particular on the inclined surface.

Therefore, one possible embodiment is that the support part has a sliding surface in order to be moved on the inclined surface by sliding or to promote sliding on the inclined surface, as the case may be. Preferably, the support part contains a material with favorable sliding properties or consists of such a material. For example, the support part is formed of or comprises polytetrafluoroethylene (PTFE). It has also been found to be advantageous if the support part consists of a polyethylene (PE), in particular a high-density polyethylene (PE-HD), or comprises such a material. In addition to the favorable sliding properties, this also gives the support part a high degree of stability.

The support part can further comprise local elevations arranged on a set-down side in order to set down the support part thereover on the inclined surface, in particular in order to slide therewith on the inclined surface. The free ends of the elevations can form the sliding surface described above. For example, the local elevations are formed by wave crests of a wavelike surface structure. In addition or alternatively, the elevations can be formed by ribs or similar designs. For example, the ribs are formed to be elongated and run with their longitudinal extension in the direction of movement of the support part relative to the inclined surface.

With one possible embodiment, the support part comprises a carriage or is formed by a carriage in order to form a linear guide with a profile rail comprising the inclined surface. For example, the carriage has at least one, preferably two, guide surfaces spaced apart from one another for laterally guiding the profile rail. For example, the guide surfaces are formed on opposite legs of the carriage. For example, a sliding surface, in particular the sliding surface described above, is arranged between the guide surfaces, over which the carriage can slide on the inclined surface. Furthermore, a securing surface can be provided, for example on at least one of the legs, in order to secure the carriage against detachment from the profile rail in a direction orthogonal to the inclined surface, in particular against lifting from the inclined surface. For example, the at least one securing surface is formed by a material section encompassing the profile rail.

In an additional embodiment, the pressing part is formed on the base body, in particular molded on the base body. This favors easy manufacture of the pressing part, since the pressing part is provided by the base body. For example, the pressing part is formed by a wall section of the mass body or the base body, as the case may be.

The cross-section of the base body can be formed to be angular, for example polygonal, in particular quadrangular. In principle, the base body can also be formed to be round in cross-section, in particular circular or oval. For example, the base body is formed to be cylindrical and/or conical in the direction of its longitudinal extension. To the extent that the base body is used to receive the pourable and/or flowable material described above, the base body can consist of plastic or metal or comprise such a material. For example, the base body consists of stainless steel or aluminum or tinplate or comprises such a material.

According to an additional embodiment, the mass body has a height and the support part has a length, wherein the height and the length are in a defined ratio relative to one another in order to achieve a favorable transmission of force to the product. It has been found that a length to height ratio should be in the range of 1 to 1.2 to 1 to 3, with a corresponding ratio value to be used depending on the size of the product. Due to the length of the supporting part compared to the height of the mass body, a tilting tendency of the pressing device on the profile rail is counteracted in the specified ratio range.

The height of the mass body is to be understood in particular as the extension of the mass body from its end turned towards the support part up to its opposite upper end. The length of the support part is to be understood in particular as the extension of the support part in the direction of movement of the pressing device.

One aspect of the disclosure relates to an assembly comprising a shelf element having a set-down surface for products and a pressing device for applying a compressive force against the products. The pressing device can be any of the embodiments of a pressing device described above. In such a case, the set-down surface is the inclined surface described above; thus, the set-down surface is placed in an inclined position.

Alternatively, the pressing device can be a pressing device whose generated compressive force is independent of its net weight and, in this respect, does not require an inclined set-down surface. To generate a compressive force acting on the products, such pressing device uses at least one elastically deformable deformation element, which is configured to release energy stored by elastic deformation as a compressive force on the products. For example, the deformation element is a mechanical, in particular metallic, spring element, whose restoring force forms the compressive force on the products.

With the assembly, it is provided that the shelf element is formed as a profile rail and is configured, with respect to the longitudinal extension of the shelf element, to set down the products in a row one behind the other on the set-down surface, and that the shelf element, as viewed in cross-section, comprises an upper side and a lower side, wherein the set-down surface is assigned to the upper side and a bar is assigned to the lower side in the region of at least one of the longitudinal ends of the shelf element, which bar extends in the longitudinal direction of the shelf element, in order to be inserted into at least one insertion receptacle of a shelf frame. With the assembly, it is further provided that the pressing device comprises a pressing part for transmitting the compressive force to the products and a support part carrying the pressing part, which support part is movably connected to the shelf element, in order to allow the movement of the pressing part and the base body along the set-down surface.

Such an assembly favors a modular structure of a shelf unit for a product display device, such as a shelf, in particular the assembly of the individual modules. Thereby, the shelf element has a dual function. On the one hand, it serves to enable the products to be placed on its set-down surface, one behind the other in a row. On the other hand, it serves as a support for the pressing device. An easy assembly of this shelf element is advantageous, because it has an insertion section due to the bar and can therefore be assembled by simple insertion.

In the case of the shelf element, it can be provided that the lower side thereof has, in each case in the region of one of the longitudinal ends, a bar that extends in the longitudinal direction of the shelf element, in order to be inserted into at least one insertion receptacle of a shelf frame. It can further be provided that the bars are a section of a common, continuous bar. This results in a reinforcement of the base element against forces or transverse forces, as the case may be, acting transversely to the longitudinal direction of the base element.

According to one embodiment, the shelf element has, viewed in cross-section, legs projecting laterally outwards from the at least one bar, which legs serve as lateral guide surfaces, with which counter-guide surfaces of the support part of the pressing device correspond, and in this manner a linear guide is formed. This makes it possible to move the pressing device part of the pressing device in a manner guided in the longitudinal extension of the shelf element, in order to cause the products to slide. In this manner, any tilting of the pressing device is counteracted if the pressing part moves in the course of a subsequent sliding process of the products.

It can further be provided that the support part of the pressing device comprises at least one securing surface, which cooperates with the lower side of the shelf element and provides a means of securing against movement of the pressing part transversely to the set-down surface of the shelf element, that is to say against the lifting of the pressing part from the set-down surface of the shelf element. As a result, a measure is taken to hold the pressing device on the shelf element in a manner such that it cannot fall out, in particular in the installed state of the shelf element on the shelf frame. In order to move the pressing part of the pressing device in a guided manner in the longitudinal extension of the shelf element and to secure it against movement transversely to the set-down surface, it is provided, for example, that the legs of the shelf element projecting laterally away from the bar are encompassed by the support part of the pressing device, forming the linear guide.

With one possible design, it is provided that the support part of the pressing device is formed as a carriage or comprises a carriage, which forms the linear guide with the shelf element. For example, the carriage has at least two guide surfaces spaced apart from one another for lateral guidance for the profile rail. For example, the free ends of the legs each form the lateral guide surface for the profile rail.

It is useful if, viewed in cross-section, the shelf element is formed in a T-shape, that is, a T-profile, and the at least one bar forms a leg of the shelf element. Such measure aims at realizing the shelf element in a technically simple manner. For example, the T-profile is an isosceles T-profile. This means, in particular, that the at least one bar divides the area of the set-down surface into two legs of equal or essentially equal size relative to one another. In principle, the shelf element can also be an L-shaped profile in cross-section. For example, one of the legs of the L-profile then forms the at least one bar and the other leg has the set-down surface.

It is further useful if the shelf element is a metal part and, in particular, is made from an extruded part. For example, the shelf element comprises or consists of aluminum or an aluminum alloy. Alternatively, the shelf element can be a formed plastic part produced by extrusion. Alternatively, the shelf element can be a hybrid component that is made of plastic and has, for example, a metallic reinforcing overlay.

According to an additional aspect, a shelf unit for a product display device is provided. The shelf unit comprises a shelf frame with a front frame part, a rear frame part and at least one, preferably two lateral frame parts, which are preferably connected to form a ring structure, wherein the front frame part and/or the rear frame part has at least one, preferably several or a plurality of insertion receptacles. The shelf unit further comprises at least one, preferably several or a plurality of shelf elements, which have a set-down surface for products and are assigned at the ends on the one hand to the front frame part and on the other hand to the rear frame part. Furthermore, the shelf unit comprises at least one, preferably several or a plurality of pressing devices for applying a compressive force against the products.

With the shelf unit, at least one of the shelf elements and at least one of the pressing devices are provided in an assembly of the type described above and are configured accordingly. It is further provided that the at least one shelf element is inserted with its at least one bar into one of the insertion receptacles of the shelf frame.

The shelf unit combines several functions into one common system. For example, in the case of the shelf unit, it is possible for products placed on one of the shelf elements to slide if a gap has been created by the removal of one or more products. For this purpose, the shelf unit has the at least one pressing device. The shelf unit further specifies an embodiment for a modular system design.

According to one embodiment, the front frame part is assigned with a product stopper, which serves as a front stop for the row of products. In addition, a product separator can be arranged between adjacent base elements, which product separator serves as a lateral boundary for the row with the products. The product separator can be assigned with its longitudinal ends on the one hand to the front frame part and on the other hand to the rear frame part, and one of the longitudinal ends can be inserted into one of the insertion receptacles. For example, the product separator is inserted with both longitudinal ends into one of the insertion receptacles in each case, wherein one insertion receptacle is provided on the front frame part and the other insertion receptacle is provided on the rear frame part.

According to an additional aspect, a product display device is provided. The product display device comprises at least one embodiment and/or design of the pressing device described above and/or at least one embodiment and/or design of the assembly described above and/or at least one embodiment and/or design of the shelf unit described above. It can be provided that, with the product display device, the set-down surface for the products is an inclined surface present in an inclined position, for example it is the inclined surface described above.

An additional aspect relates to at least one use. According to one embodiment, a use of a dimensionally stable transport and/or storage container, for example from the chemical industry, is provided, which is used as a base body of the pressing device described above. For example, the dimensionally stable transport and/or storage container is a container for paints.

According to an additional embodiment, a use of a pourable and/or flowable material for use as a filling material of the base body of the pressing device described above is provided. The material is, for example, a sand, in particular quartz sand, or a liquid, such as water, in particular tap water.

According to an additional embodiment, the use of a cement-containing building material for manufacturing the casted base body of the pressing device described above is provided.

According to an additional aspect, a method of manufacturing a pressing device is provided, comprising the following steps:

a) providing a casting mold negatively reproducing the base body of the pressing device described above;
b) pouring of a liquid concrete material into the casting mold;
c) drying of the concrete material, at least until a dimensionally stable blank is obtained;
d) separating the blank from the mold;
e) impregnating the blank by an impregnating agent, by which penetration of moisture or other foreign substances into the blank is prevented and furthermore the surface of the blank remains open to diffusion.

In this manner, it is possible to manufacture the above-described casted base body in a technically simple and cost-effective manner.

According to an additional form, it is provided that the blank is ground on its contact side with the support part prior to or after impregnation, in order to favor the prerequisite for product adhesion when the support part is adhered to the base body.

According to an additional aspect, an extruded plastic profiled element is provided for manufacturing the support part of the pressing device described above. The plastic profiled element has a plate-shaped upper part, which has material sections at an angle to one another on opposite sides, through which a slot-shaped passage is formed in order to form an insertion receptacle for a shelf element.

Such a plastic profiled element can be cut to a predetermined length, which can be used as a support part in the pressing device described above. For example, the plastic profiled element consists of a PE-HD or a PE or a PTFE or comprises such a material.

Further details and features of the invention will be apparent from the following description of at least one exemplary embodiment with reference to the drawing.

DETAILED DESCRIPTION

Figure 1:
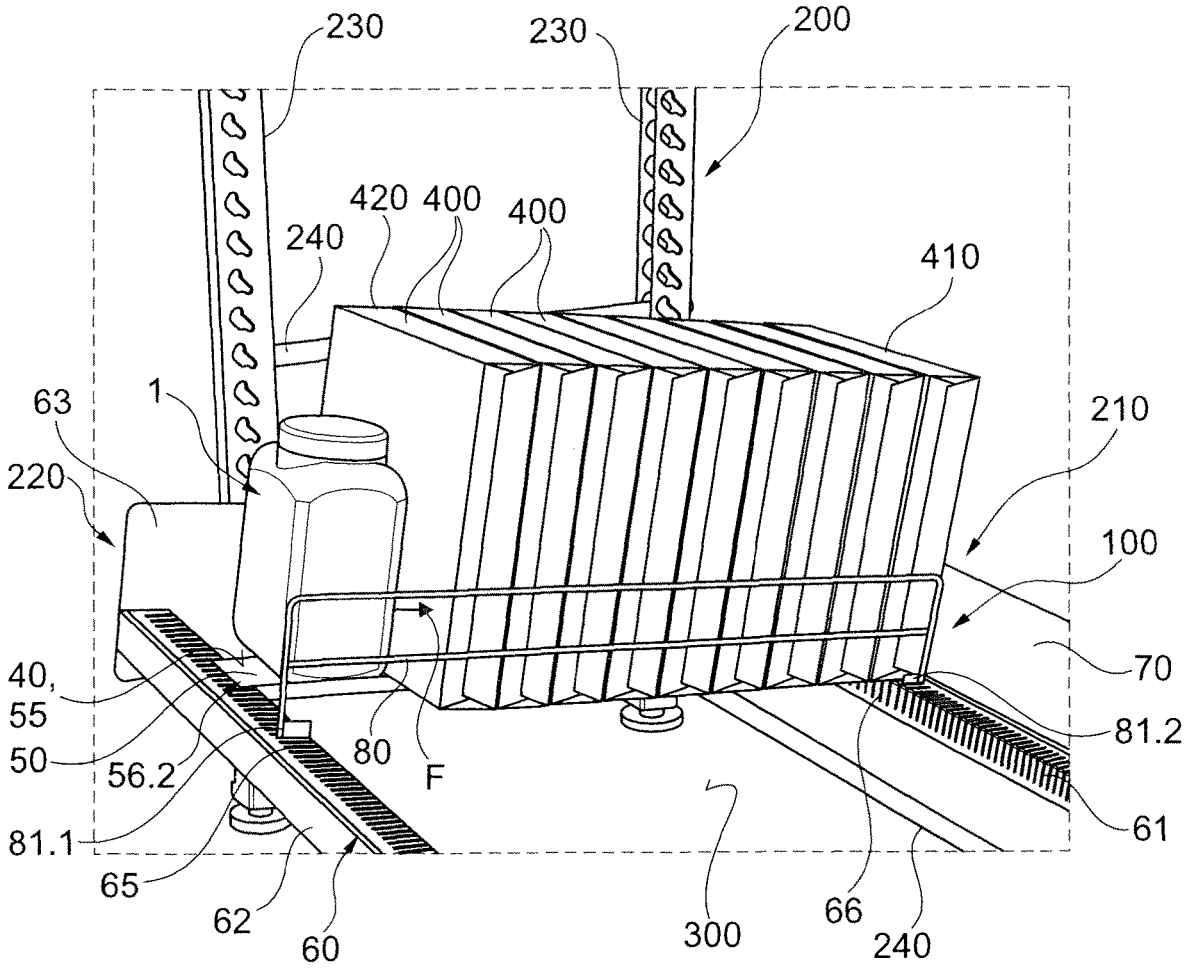
FIG. 1 shows a possible embodiment of a product display device with a shelf element for supporting products and a pressing device for applying a compressive force against the products in perspective view.

FIG. 1 shows—in schematic view and in a cut-out—a possible embodiment of a product display device 200, in particular of a shelf or shelf system. The product display device 200 includes a front side 210 and a rear side 220, and a shelf assembly 100 arranged therebetween. The shelf unit 100 is formed to support several or a plurality of products 400, which are shown by way of example in FIG. 1.

Preferably, the product display device 200 comprises at least one, preferably several vertical supports 230, to which the product display device 200 is fastened. For example, the vertical supports 230 are positioned with one end, for example via a foot part, on a contact surface 300, for example a base or a floor. Preferably, the vertical supports 230 are interconnected by crosspieces 240.

Preferably, the shelf assembly 100 comprises a shelf frame 60. For example, the shelf frame 60 has a front frame part 61, a rear frame part 62 and at least one, preferably two, lateral frame parts 63, wherein the frame parts 61, 62, 63 are connected to form a ring structure. Preferably, the front frame part 61 is assigned to or is turned towards the front side 210 and the rear frame part 62 is assigned to or is turned towards, as the case may be, the rear side 220 of the product display device 200. In FIG. 1, only one of the lateral frame parts 63 and only two of the vertical supports 230 are visible, due to the view in a cut-out.

Preferably, the front frame part 61 and/or the rear frame part 62 comprises at least one, in particular several or a plurality of insertion receptacles 65, 66. For example, the insertion receptacles 65, 66 are slot-shaped, wherein the longitudinal extension of the slot-shaped insertion receptacles 65, 66 are parallel or essentially parallel to the lateral frame parts 63, 64. The insertion receptacles 65, 66 are used to fasten functional parts of the shelf unit 100, which will be described in further detail below by way of example.

As shown FIG. 1, the products 400 shown there are placed on a set-down surface 55 of a shelf element 50. Preferably, the shelf element 55 is formed to be elongated. Preferably, the shelf element 50 is attached, in particular fastened, with its longitudinal ends 56.1, 56.2 (FIG. 2) on the one hand to the front frame part 61 and on the other hand to the rear frame part 62.

For example, the set-down surface 55 can be arranged in an inclined position. The set-down surface 55 then forms an inclined surface 40. The inclined surface 40 is oriented such that the front frame part 61 is lower relative to the rear frame part 62, such that the inclined surface 40 extends downwardly at an angle towards the front frame part 61. For example, the inclined position of the set-down surface 55 can be achieved by placing the entire shelf unit 100 in an inclined position and mounting it in such inclined position on the vertical supports 230.

Preferably, the products 400 are placed in a row one behind the other on the set-down surface 55 and preferably the row with the products 400 extends in the longitudinal direction of the shelf element 50. Preferably, in order to prevent the frontmost product 410 in the row from falling out, a product stopper 70 is assigned to the front frame part 61, which is formed, for example, by a bar projecting upwardly from the front frame part 61.

The inclined position of the set-down surface 55 and the arrangement of the products 400 in the one row make it possible that, when one or more of the products 400 are removed, the remaining products 400 slide such that a gap in the row caused by the removed products is closed again. In order to support and/or trigger such sliding, a pressing device 1 is preferably provided. For example, the pressing device 1 presses against the rearmost product 420 of the row, thereby applying a compressive force F against the products 400. For this purpose, the pressing device 1 uses its net weight, which, due to the inclined position of the set-down surface 55, has a force component that is directed parallel or essentially parallel to the set-down surface 55 and thus forms the compressive force F. Preferably, the pressing device 1 is connected to the shelf element 50 in such a manner that the pressing device 1 is free to move at least in the longitudinal direction of the shelf element 50, such that the pressing device 1 can move along with the sliding products.

With the exemplary embodiment of FIG. 1, the products 400 are arranged between one of the lateral frame parts 63 and a product separator 80, which serve as a lateral boundary for the row containing the products 400. The product separator 80 can be in the form of a bracket. Preferably, the product separator 80 is attached, in particular fastened, with its longitudinal ends 81.1, 81.2 to the front frame part 61 on the one hand and to the rear frame part 62 on the other hand. Preferably, the longitudinal ends 81.1, 81.2 are inserted into one of the insertion receptacles 65 of the front frame part 61 and/or into one of the insertion receptacles 66 of the rear frame part 62.

Figure 2:
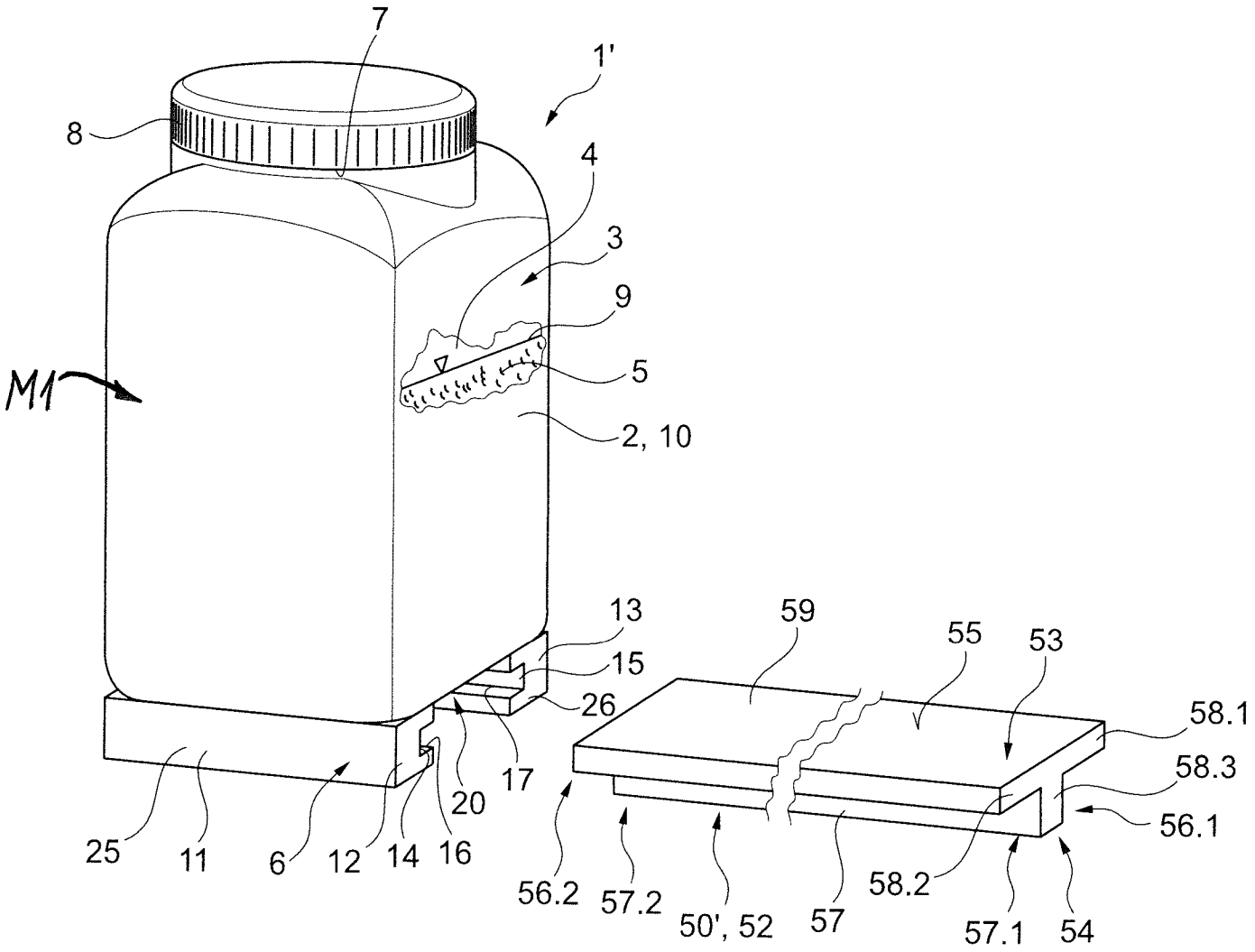
FIG. 2 shows an additional embodiment of a pressing device and a shelf element in perspective view.

FIG. 2 shows a possible embodiment of a pressing device 1' along with a possible embodiment of a shelf element 50'. The pressing device 1' and the shelf element can be used, for example, with the shelf unit 100 of the product display device 200 in accordance with FIG. 1. Components of the pressing device 1' and/or the shelf element of FIG. 2 that are identical or functionally identical to the pressing device 1 and/or the shelf element 50 of FIG. 1 are provided with the same reference signs. In this respect, reference is made to the description of the pressing device 1 or the shelf element 50, as the case may be, in accordance with FIG. 1.

The pressing device 1' preferably comprises a pressing part 2 for transmitting the compressive force F to the products 400 (FIG. 1). Preferably, the pressing device 1' further comprises a mass body M1, which has a predefined mass in order to apply a defined weight force by which the compressive force F is effected. For this purpose, the mass body M1 can have a base body 3 with at least one cavity 4, which can be seen in the partial section of FIG. 2. Preferably, a predetermined quantity of a pourable and/or flowable material 5, such as sand, is filled into the cavity 4 to create the defined weight force. Preferably, the base body 3 has a filling opening 7, which forms an inlet to the cavity 4. Preferably, a cover element 8 is further provided in order to close the filling opening 7. For example, the cavity 4 further comprises a seal 9 in order to retain the filled material in the cavity 4.

The pressing device 1' further comprises a support part 6 carrying the pressing part 2 and the base body 3. The support part 6 is configured to be movably connected to the shelf element 50', in order to allow the movement of the pressing part 2 and the base body 3 along the set-down surface 55 of the shelf element 50'. Preferably, the support part 6 and the shelf element 50' form a linear guide in order to move the support part 6 along the shelf element 50' in a guided manner along the set-down surface 55. For example, the support part 3 is formed as a carriage 11 for this purpose or comprises a carriage 11.

Preferably, it is provided that the pressing part 2 is formed by a wall section 10 of the base body 3. For example, the base body 3 has a pressing surface for transmitting the compressive force F. For example, the base body 3 is a dimensionally stable container. The dimensionally stable container can be a commercially available transport and/or storage container that is used, for example, for storing and/or transporting liquids and/or bulk materials. Preferably, the container is angular in cross-section, for example quadrangular, whereas the filling opening 7 and the associated cover element 8 are preferably located at its upper end.

The shelf element 50' is preferably a profile rail 52. For example, the shelf element 50' is a metal part and is made from an extrusion, for example. Preferably, the shelf element 50' is an aluminum part and consists of aluminum or an aluminum alloy or comprises aluminum or an aluminum alloy. Preferably, the shelf element 50' is configured, with respect to its longitudinal extension, to set down products in a row one behind the other on its set-down surface 55.

The shelf element 50' has, viewed in cross-section, an upper side 53 and a lower side 54, wherein the upper side 53 provides the set-down surface 55. The lower side 54 includes, in the region of at least one of the longitudinal ends 56.1, 56.2, preferably in the region of the respective longitudinal end 56.1, 56.2, a bar 57.1 or 57.2, as the case may be, which extends in the longitudinal direction of the shelf element 50'. Preferably, the respective bar 57.1 or 57.2, as the case may be, is formed as a section of a common, for example continuous, bar 57. At the longitudinal ends 56.1, 56.2 of the shelf element 50', the bar 57 forms an insertion section, via which the shelf element 50' can be inserted into one of the insertion receptacles 65 and/or into one of the insertion receptacles 66 of the shelf frame 60.

Preferably, the set-down surface 55 is formed by two legs 58.1, 58.2, each projecting laterally outwardly from the bar 57. Preferably, the bar 57 forms a further leg 58.3 of the shelf element 50'. For example, the shelf element 50' is formed in a T-shape in cross-section. Preferably, the set-down surface 55 has favorable sliding or slipping properties, as the case may be, in order to promote the sliding or slipping, as the case may be, of the support part 6 of the pressing device 1' on the set-down surface 55 of the shelf element 50'. For this purpose, the set-down surface 55 can be formed on a slip layer 59, which is applied as a coating to the upper surface 53 of the shelf element 50'.

Figure 3:
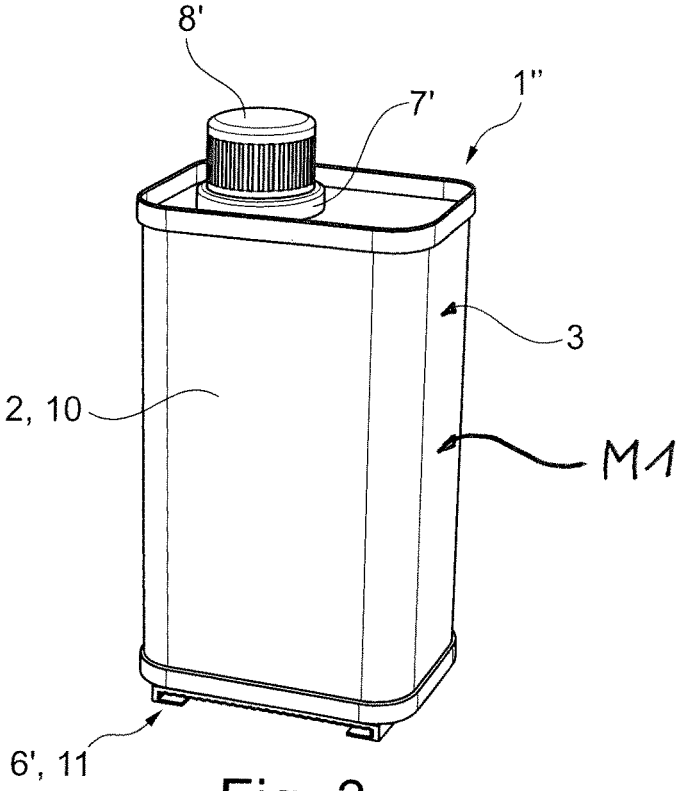
FIG. 3 and FIG. 4 show an additional embodiment of a pressing device in different perspective views.
Figure 4:
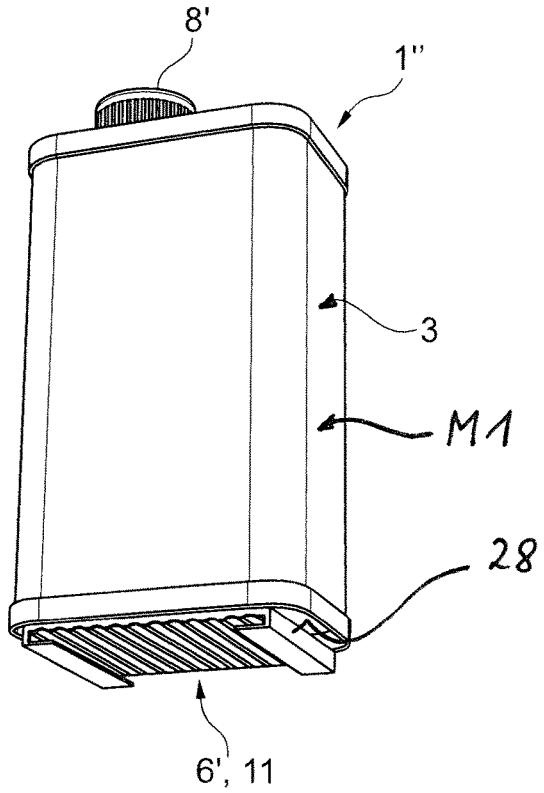

FIGS. 3 and 4 show an additional possible embodiment of a pressing device 1", which is applicable to the shelf unit 100 of the product display device 200 in accordance with FIG. 1. Components of the pressing device 1" that are identical or functionally identical to the pressing device 1 of FIG. 1 and/or the pressing device 1' of FIG. 2 are provided with the same reference signs. In this respect, reference is made to the description of the pressing device 1 or the pressing device 1', as the case may be.

With the pressing device 1", the base body 3 is formed by a metallic container. The container is, for example, a commercially available transport and/or storage container for paints or similar liquids. For example, the container is made of tinplate or comprises tinplate, as the case may be. Preferably, the container is cylindrical in shape and has on its upper side an essentially horizontal front end section, in which a filling opening 7' is provided in order to allow the pourable and/or flowable material 5 to be filled in. The filling opening 7' can be closed or is closed, as the case may be, with a corresponding cover element 8'.

At its lower end, the container has a support part 6' carrying the container. The support part 6', like the support part 6 of the pressing device 1' in accordance with FIG. 2, is configured to be movably connected to the set-down surface 55 of the shelf element in order to allow the movement of the pressing part 2 and the base body 3 along the set-down surface 55.

Figure 5:
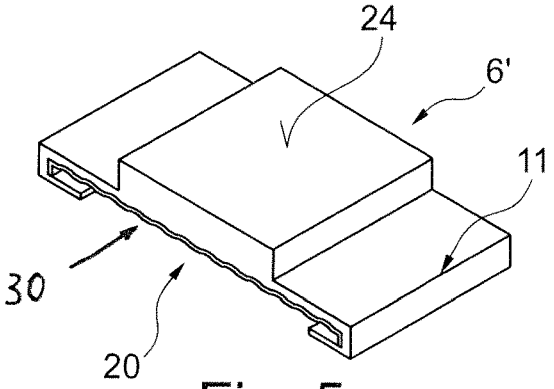
FIG. 5 shows a possible embodiment of a support part for the pressing devices of FIGS. 1, 2 and 3 in perspective view.
Figure 6:
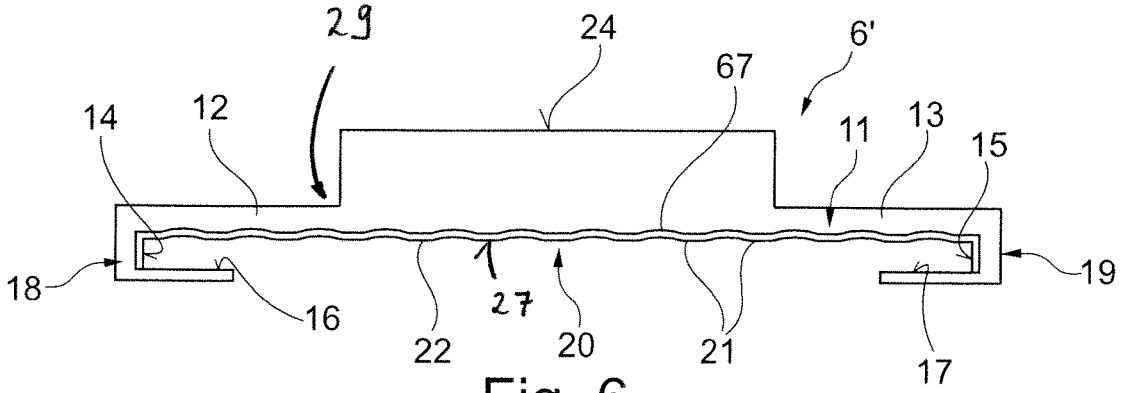
FIG. 6 shows the support part of FIG. 5 in sectional view.

FIGS. 5 and 6 show the support part 6' in perspective view (FIG. 5) and in sectional view (FIG. 6). Preferably, the support part 6' has a connection surface or contact surface 24, as the case may be, on its upper side, via which the connection to the base body 3 is established or will be established, as the case may be. Preferably, the base body 3 has a counter-contact surface 28 (FIG. 4). Preferably, the contact surface 24 is formed as an adhesive flange, in order to fasten the support part 6 to the base body 3 by means of adhesive bonding, for example by means of a double-sided adhesive tape. In principle, the contact surface 24 can also be connected to the base body 3 by means of other connection techniques.

Preferably, the lower side of the support part 6' is assigned with a set-down side 20 that, in the assembled state of the support part 6', is turned towards the contact surface 55 of the shelf element 50'. Preferably, the support part 6' has a plurality of local elevations 21 on the set-down side 20, in order to set down or support, as the case may be, the support part 6' thereover on the set-down surface 55 of the shelf element 50. The local elevations 21 reduce the sliding surface with the set-down surface 55, thereby promoting sliding of the support part 6' on the set-down surface 55 of the shelf element 50'. The elevations 21 can be formed in that, at the set-down side 20, the surface has a waveform 22. The elevations 21 are then respectively formed by the crests or troughs of the waveform 22. The waveform 22 can be part of a sliding coating in order to promote the sliding properties of the surface.

Figure 7:
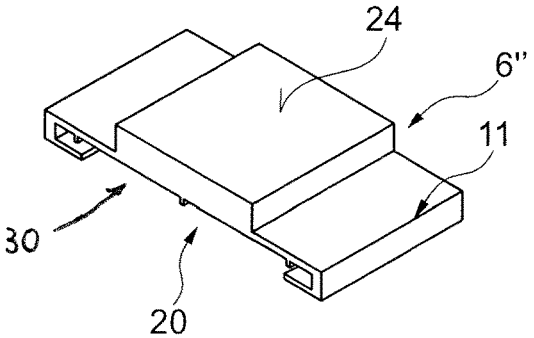
FIG. 7 shows an additional possible embodiment of a support part for the pressing devices of FIGS. 1, 2 and 3 in perspective view.
Figure 8:
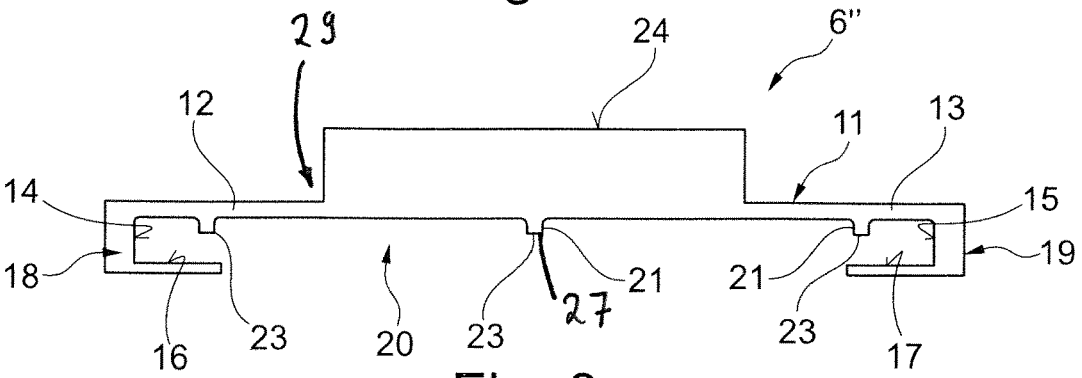
FIG. 8 shows the support part of FIG. 7 in sectional view.

FIGS. 7 and 8 show a possible embodiment of a support part 6", which can be present in the pressing device 1" of FIGS. 3 and 4. With the support part 6", in contrast to the support part 6' of FIGS. 5 and 6, the elevations 21 on the set-down side 20 are formed by several ribs 23 arranged in a distributed manner. Preferably, the ribs 23 extend with their longitudinal extension in the direction of movement of the support part 6" on or at the shelf element 50' if a subsequent sliding occurs due to the removal of products.

The support parts 6' and 6" are preferably each provided with guide surfaces 14, 15 spaced apart from one another, in order to cooperate with counter-guide surfaces of the shelf element 50' to form the linear guide. Preferably, the guide surfaces 14, 15 are arranged transversely to the set-down side 20, in particular perpendicularly to the set-down side 20. For example, the guide surfaces 14, 15 are each formed by material sections 18, 19 projecting laterally downwards from the lower side.

For example, the material sections 18, 19 are each arranged on legs 12, 13, which project laterally outwardly from a base body 29 having the contact surface 24. Preferably, the guide surfaces 14, 15 are spaced apart from one another in such a manner as to receive the shelf element 50' therebetween. For example, the counter-guide surfaces used by the shelf element 50' are formed by end faces of the shelf element 50', which are arranged transversely to the set-down surface 55 and extend with a longitudinal extension in the longitudinal direction of the shelf element 50'.

Preferably, the support part 6' or 6", as the case may be, is also secured against being lifted from the shelf element 50'. For this purpose, securing surfaces 16, 17 can be provided, which are arranged in a manner spaced from and parallel to or essentially parallel to a sliding surface 27 of the support part 6. Preferably, the securing surfaces 16, 17 are formed on the material sections 18, 19. Preferably, the material sections 18, 19 for this purpose are each formed in such a manner that, in the installed state of the support part 6' or 6", as the case may be, on the shelf element 50', they encompass the free ends of the legs 58.1, 58.2, in particular form an insertion receptacle 30. The mounting of the pressing device 1' on the shelf element 50' is carried out in such a manner that the support part 6' or 6", as the case may be, starting from an end-side end 56.1 or 56.2, as the case may be, of the shelf element 50', is pushed on in the direction of the longitudinal extension of the shelf element 50'.

The above-described design of the support part 6' or 6", as the case may be, with its guide surfaces 14, 15 and the material sections 18, 19 can also be realized in the support part 6 of FIG. 2. The above-described design of the support part 6' or 6", as the case may be, with its securing surfaces 16, 17 can also be realized with the support part 6 of FIG. 2.

In contrast to the support part 6' of FIGS. 5 and 6, the support part 6 of the pressing device 1' in accordance with FIG. 2 shows an embodiment that comprises two parts 25, 26 spaced part from one another, between which the shelf element 50' can be inserted. For example, each of the parts 25, 26 is connected to the base body 3 via a respective contact surface provided on the upper side, for example by means of adhesive bonding. In the installed state of the pressing device 1' on the shelf element 50', each of the parts 25, 26 preferably rests on the set-down surface 55, wherein, for example, in the region between the parts 25, 26, the lower side of the base body 3 is present at a distance from the set-down surface 55. For example, a free space is provided between the lower side of the base body 3 and the set-down surface 55.

Figure 9:
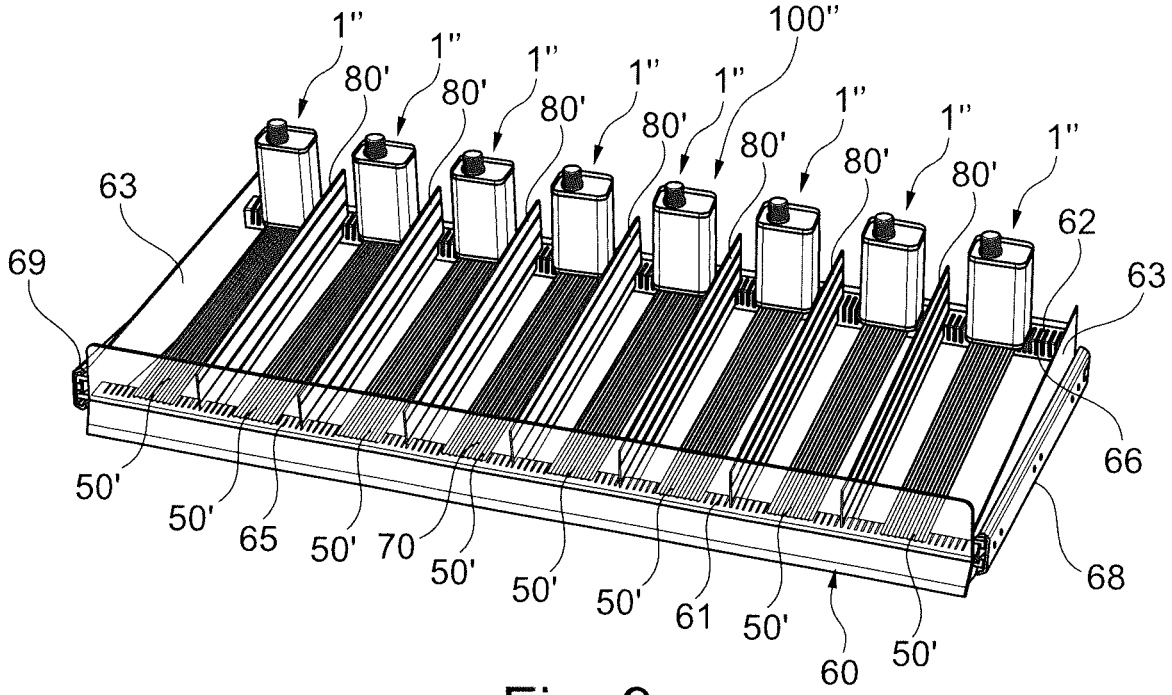
FIG. 9 shows a possible embodiment of a shelf unit with several shelf elements and associated pressing devices in perspective view.

FIG. 9 shows a shelf unit 100", which can be installed in the product display device 200 of FIG. 1. The shelf unit 100" has the shelf frame 60 already described above with the front frame part 61, the rear frame part 62, the lateral frame parts 63, wherein the front frame part 61 and the rear frame part 62 have a plurality of the insertion receptacles 65, 66 as already described above.

The shelf unit 100" can have a hinge element 68 or 69, as the case may be, mounted on each of the lateral frame parts 63. The hinge element 68 or 69, as the case may be, can be a telescopic hinge, such that the shelf unit 100" can be slid out from an installation position to a refill position. The shelf frame 60 can be moved to an inclined position relative to the hinge elements 68, 69. For this purpose, a mechanism can be provided by the respective lateral frame part 63 and the associated hinge element 68, 69 in order to effect an inclined position in a stepless or stepped manner to various inclined locations.

In the case of the shelf unit 100", a plurality of the shelf elements 50' already described above are provided, which are arranged at a distance from one another between the lateral frame parts 63 and are each supported on the one hand on the front frame part 61 and on the other hand on the rear frame part 62, preferably being inserted with their respective bar 57 into one of the insertion receptacles 65, 66 of the front frame part 61 or rear frame part 62, as the case may be.

On the respective shelf element 50', or on at least individual items of the shelf elements 50', the pressing device 1" of FIGS. 3 and 4 already described above is provided. In addition or alternatively, the pressing devices 1 and/or 1' can also be provided there. Complementary or alternative shelf elements 50 can also be provided there. By way of example, the pressing devices 1" are shown in the region of the rear end of the shelf unit 100", that is in the region of the rear frame part 62. If the set-down surfaces 55 of the shelf elements 1" were inclined, the pressing devices 1" would automatically slide from such rear position in a forward direction.

Preferably, a product stopper is provided on the front frame part 61, for example in the manner of the product stopper 70 described above. Preferably, the product stopper runs continuously between the lateral frame parts 63. A function bar 71 can also be provided on the front frame part, which can be used, for example, as a support for price labels. A product separator 80' is provided between each adjacent shelf element, which is for example flat; in particular, it can be formed from a flat profile or sheet metal part. Preferably, the product separators 80' are inserted at their ends into one of the insertion receptacles 65 and/or into one of the insertion receptacles 66 of the front frame part 61 or of the rear frame part 62, as the case may be.

Defined slides for products are formed by the product separators 80' and the lateral frame parts 63 respectively. There, the products can each be placed in a row one behind the other on the respectively provided set-down surface of the at least one shelf element 50'. The products are then respectively located between the product stopper 70 and the associated pressing device 1". In principle, it can also be provided that more than the one shelf element 50' is present between the product separators 80'. For example, at least two such shelf elements 50' can be provided.

Figure 10:
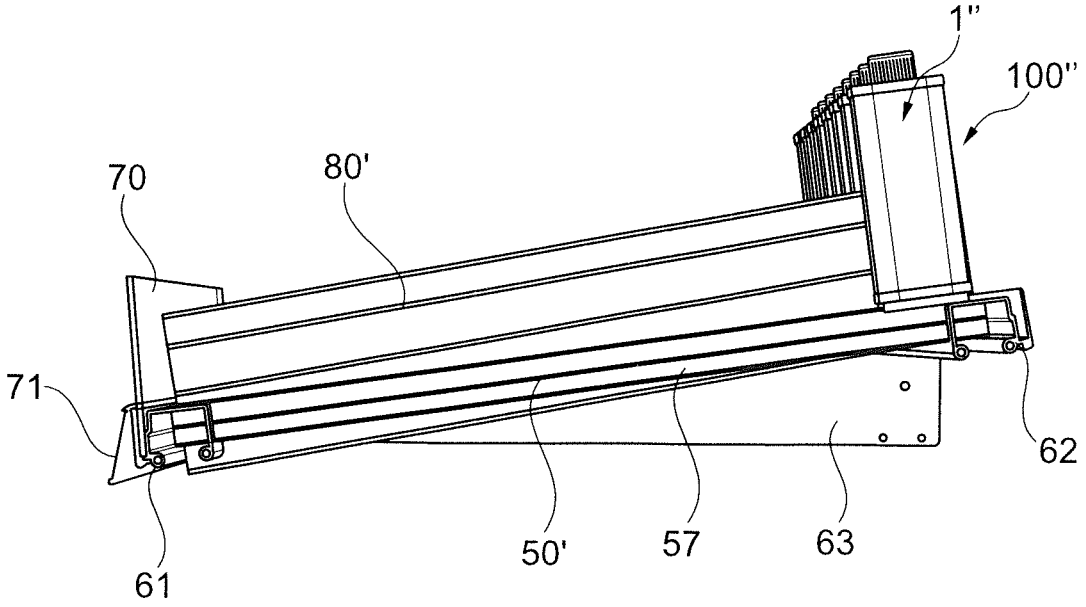
FIG. 10 shows the shelf unit of FIG. 9 in a sectional view from one side.
Figure 11:
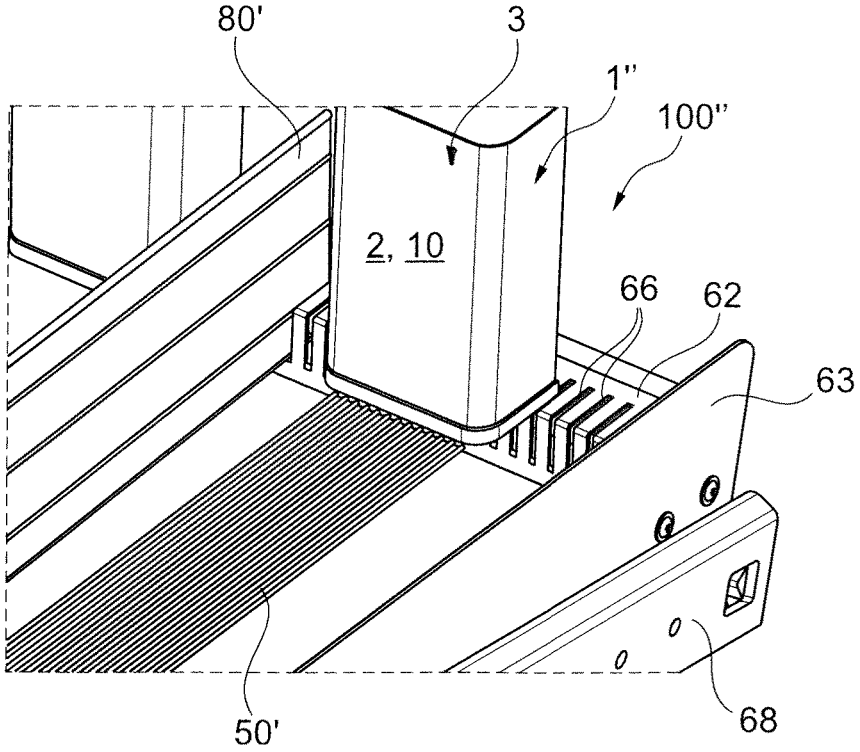
FIG. 11 shows the shelf unit in accordance with FIG. 9 as a cut-out in the area of one of the pressing devices in a perspective view from above.
Figure 12:
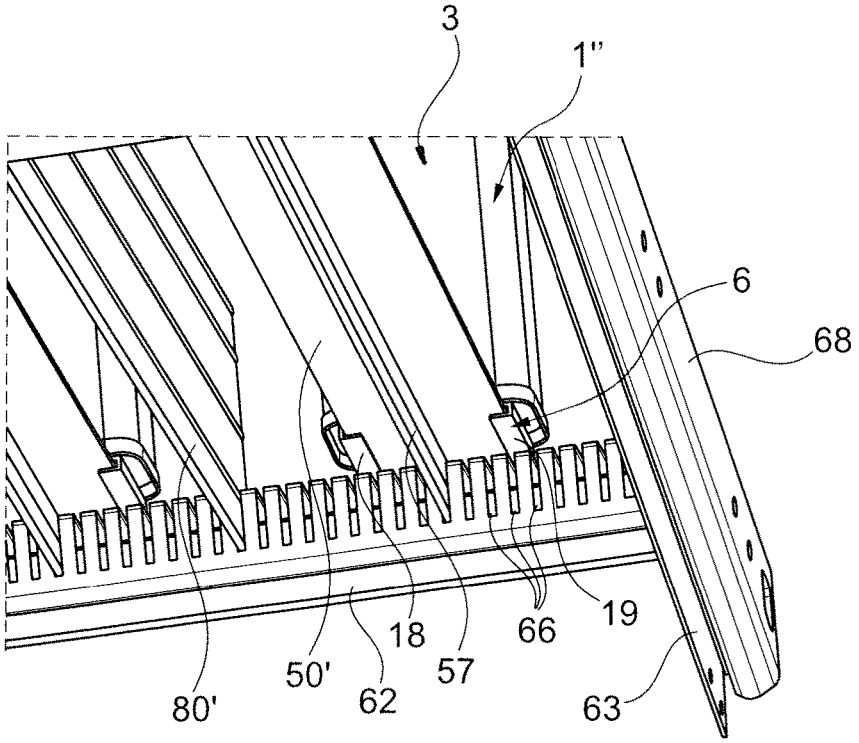
FIG. 12 shows the shelf unit in accordance with FIG. 9 as a cut-out in the area of one of the pressing devices in a perspective view from below.

FIG. 10 shows the assembly and design of the shelf frame 100' in a side view, wherein one of the lateral frame parts 63 with the associated hinge element 68 is omitted. FIGS. 11 and 12 each show a cut-out in the region of one of the pressing devices 1", which is connected to the associated shelf element 50', wherein, for example, at least one of the pressing devices 1" is arranged, in particular held, on the associated shelf element 50', forming the linear guide described above.

Figure 13:
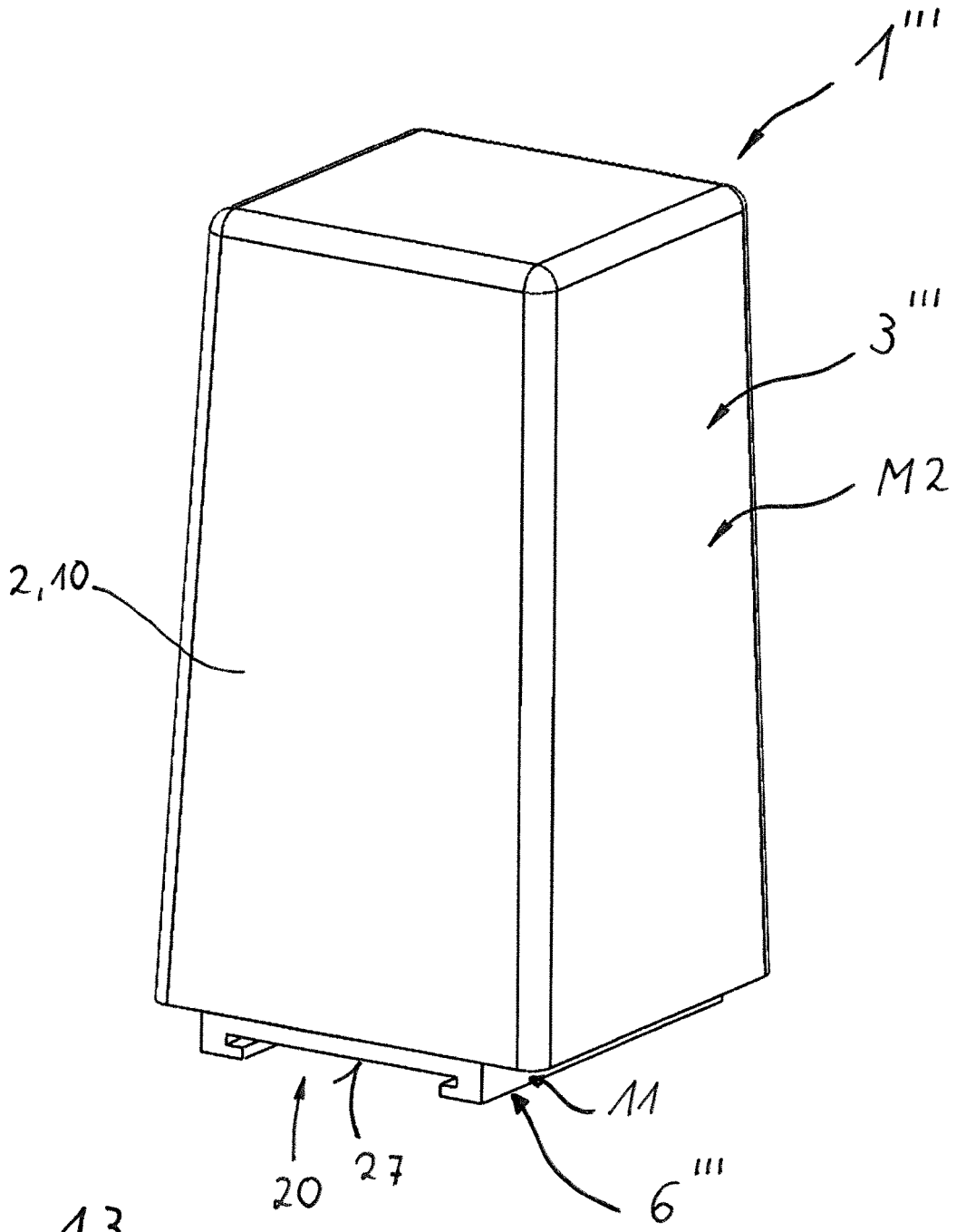
FIG. 13 and FIG. 14 show an additional embodiment of a pressing device in different perspective views.
Figure 14:
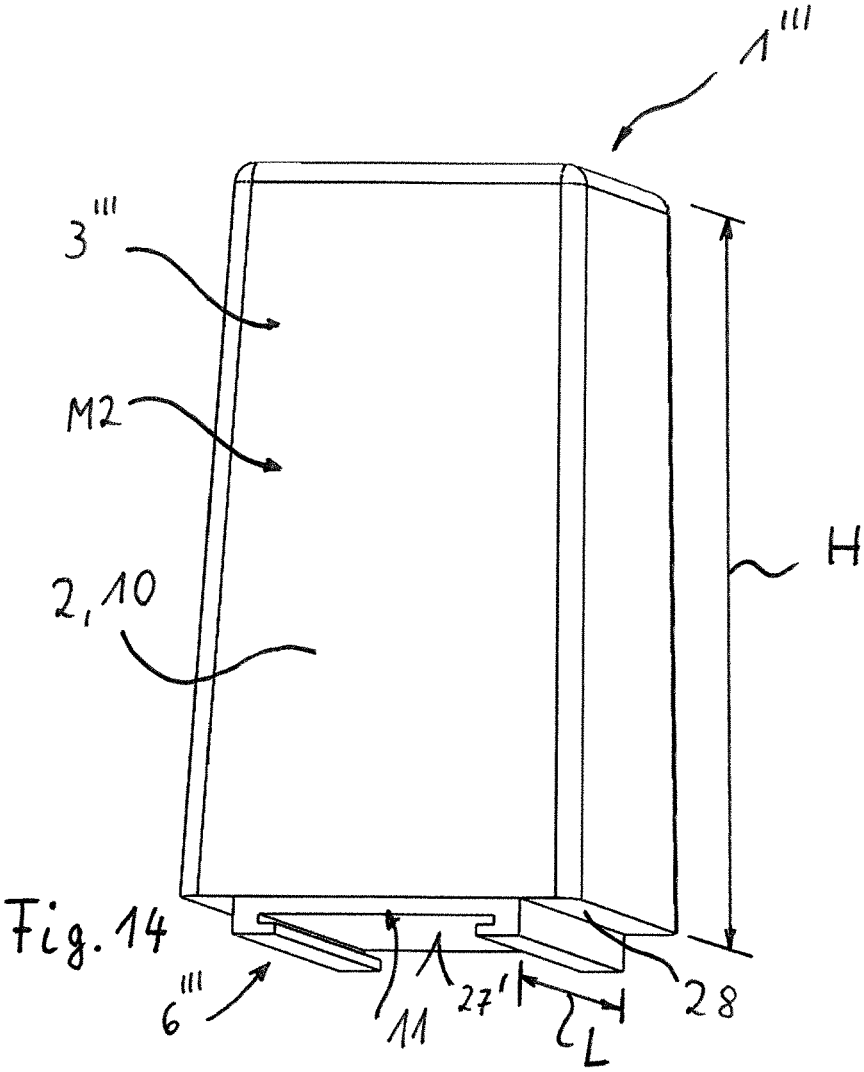

FIGS. 13 and 14 show an additional possible embodiment of a pressing device 1''', which is applicable to the shelf unit 100 of the product display device 200 in accordance with FIG. 1. Components of the pressing device 1''' that are identical or functionally identical to the pressing device 1 of FIG. 1 and/or the pressing device 1' of FIG. 2 and/or the pressing device 1" of FIG. 3 are provided with the same reference signs. In this respect, reference is made to the description relating to the pressing device 1 or the pressing device 1' or the pressing device 1", as the case may be.

The pressing device 1" of FIGS. 13 and 14 differs from the pressing device 1 or the pressing device 1' or the pressing device 1", as the case may be, among other things in that a mass body M2 is provided, which has a base body 3''', wherein the base body 3''' is preferably produced by casting. Preferably, for this purpose, the base body 3''' is formed from a solidified concrete material or comprises such a material. Preferably, the concrete material comprises a cement and a coarse aggregate, such as a quartz sand. Preferably, the cement is provided relative to the coarse aggregate in a quantity ratio of between 1:2 and 1:4. For example, the quantity ratio is approximately 1:3, wherein one part of the cement compared to three parts of the coarse aggregate is present.

In order to protect the base body 3''' from mold infestation, the base body 3''' is preferably surface-treated. Preferably, an impregnation partially or completely surrounding the base body is provided for this purpose, by means of which, on the one hand, the penetration of moisture or other foreign substances into the base body 3''' is prevented and, on the other hand, the surface of the base body 3''' remains open to diffusion. The design open to diffusion of the surface ensures that any residual moisture in the concrete material from the production process can still dry off.

Preferably, the mass body M2 or the base body 3''', as the case may be, is formed as a hexahedron. For example, the mass body M2 or the base body 3''', as the case may be, has a cube shape or an elongated cube shape, with which the four opposing base sides are rectangular. The opposing base sides have a height H, which extends from the lower side, that is, the side with the counter-contact surface 28, to a free upper end. Preferably, the height H has a ratio of between 1 to 1.2 and 1 to 3 with respect to the length L of the support 6''', wherein the length L is the extension of the support 6''' in the direction of movement of the pressing device 1''' (FIG. 14).

For example, in the case of a cube-shaped base body 3''', the ratio between the length L and the height H is 1 to 1.5. Preferably, the ratio between the length L and the height H for the mass body M2 with rectangular opposite sides is 1 to 2.

Figure 15:
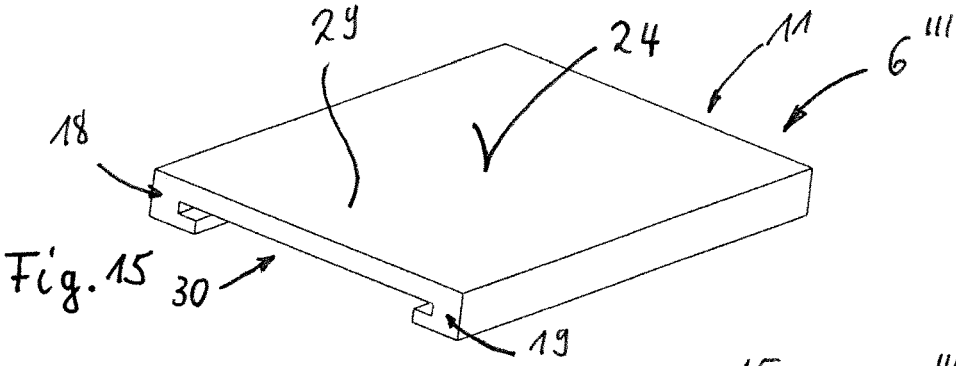
FIG. 15 shows an additional possible embodiment of a support part for the pressing devices of FIGS. 1, 2, 3 and 13 in perspective view.
Figure 16:
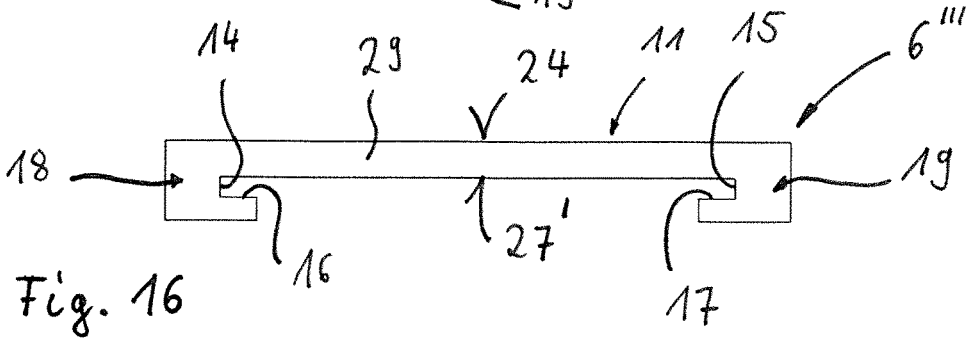
FIG. 16 shows the support part of FIG. 15 in sectional view.

FIGS. 15 and 16 show the support part 6''' of the pressing device 1''' of FIG. 14 in a stand-alone position. In the case of the support part 6", unlike the support part 6' and the support part 6", the base body 29 is formed without a raised contact surface. In the case of the support part 6", the contact surface 24 is formed on the upper side of the base body 29, which contact surface is preferably located continuously in one plane. Preferably, the support part 6" has a sliding surface 27', which is rectilinear or essentially rectilinear. Preferably, the support part 6" is an integrally molded plastic part. Preferably, the support part 6" is formed by a sliding material or comprises a sliding material at least in the region of the sliding surface 27'. For example, one such material is a PE-HD.

The basic parameters for the ranges mentioned in the present description also include, in particular, the basic parameters themselves for the respective range. The specified ranges also include any individual values contained therein.

In the present description, reference to a particular aspect or a particular embodiment or a particular design means that a particular feature or a particular characteristic described in connection with that respective aspect or the respective embodiment or the respective design is at least included therein, but is not necessarily included in all aspects or embodiments or designs. It is expressly understood that any combination of the various features and/or structures and/or characteristics described in foregoing is possible, unless expressly or clearly contradicted by the context.

The use of any or all examples or exemplary expression in the text is intended only to illustrate the invention and does not constitute a limitation as to the scope of the invention.

LIST OF REFERENCE SIGNS

1 Pressing device
1' Pressing device
1" Pressing device
1" Pressing device
2 Pressing part
3 Base body
3" Base body
4 Cavity
5 Material
6 Support part
6' Support part
6" Support part
6" Support part
7 Filling opening
7' Filling opening
8 Cover element
8' Cover element
9 Seal
10 Wall section
11 Carriage
12 Leg
13 Leg
14 Guide surface
15 Guide surface
16 Securing surface
17 Securing surface
18 Material section 19 Material section
20 Set-down side
21 Elevations
22 Waveform
23 Ribs
24 Contact surface
25 Part
26 Part
27 Sliding surface
27' Sliding surface
28 Counter-sliding surface
29 Base body
30 Insertion receptacle
40 Inclined surface
50 Shelf element
50' Shelf element

52 Profile rail
53 Upper side
54 Lower side
55 Set-down surface
56.1 End
56.2 End
57 Bar
57.1 Bar
57.2 Bar
58.1 Leg
58.2 Leg
58.3 Leg
59 Slip layer 60 Shelf frame
61 Front frame part
62 Rear frame part
63 Lateral frame parts
65 Insertion receptacles
66 Insertion receptacles
67 Hinge element
68 Hinge element
70 Product stopper
71 Function bar
80 Product separator
80' Product separator
81.1 End
81.2 End
100 Shelf unit
100' Shelf unit
100" Shelf unit
200 Product display device
210 Front side
220 Rear side
230 Vertical supports
240 Crosspieces
300 Contact surface
400 Products
410 Frontmost product
420 Rearmost products
F Compressive force
M1 Mass body
M2 Mass body H Height
L Length

The invention claimed is:

1. A pressing device (1; 1'; 1"; 1'") for applying a compressive force (F) against products (400) of a product display device (200), comprising:

a pressing surface (2) for transmitting the compressive force (F) to the products, the pressing surface (2) being part of a mass body (M1; M2) having a predefined mass for applying a defined weight force by which the compressive force (F) is effected; and a support part (6; 6'; 6"; 6'") carrying the mass body (M1; M2), which is configured to be movably connected to an inclined surface (40) carrying the products (400), in order to allow a movement of the pressing device (1; 1'; 1"; 1'") along the inclined surface (40), wherein the mass body (M1; M2) is fastened to the support part (6; 6'; 6"; 6'"), wherein the support part (6; 6'; 6"; 6'") includes two parallel guide surfaces (14, 15) spaced apart from one another and configured to cooperate with counter-guide surfaces of a shelf element (50) to form a linear guide, two securing surfaces (16, 17) extending towards one another from lower ends of the parallel guide surfaces (14, 15) perpendicular to the guide surfaces (14, 15) and below the shelf element (50), the two securing surfaces (16, 17) being configured to prevent the pressing device (1; 1'; 1"; 1'") from being lifted off the shelf element (50), and a sliding surface (27) extending perpendicular to the guide surfaces (14, 15), the sliding surface (27) being supported on the inclined surface (40) of the shelf element (50), and wherein the two parallel guide surfaces (14, 15), the two securing surfaces (16, 17), and the sliding surface form two U-shaped portions of the support part (6; 6'; 6"; 6'") that face each other and receive the shelf element (50) therebetween.

2. The pressing device according to claim 1, wherein the mass body (M1) comprises a base body (3) with a cavity (4), in which a predetermined quantity of a pourable and/or flowable material (5) is filled, in order to generate the defined weight force.

3. The pressing device according to claim 2, wherein the cavity (4) comprises a seal (9) in order to hold the pourable and/or flowable material (5) in the cavity (4).

4. The pressing device according to claim 2, wherein the base body (3) is a dimensionally stable container filled with solidified concrete material.

5. The pressing device according to claim 1, wherein the support part (6; 6'; 6"; 6'") comprises a carriage (11) to form a linear guide with a profile rail (52) having the inclined surface (40).

6. The pressing device according to claim 2, wherein the support part (6; 6'; 6"; 6'") has a contact surface (24) and the mass body (M1; M2) and/or the base body (3; 3'") has a counter-contact surface (28), which are formed as an adhesive surface and the support part (6; 6'; 6"; 6'") and the mass body (M1; M2) and/or the base body (3; 3'") are fastened to one another thereover by means of an adhesive.

7. The pressing device according to claim 6, wherein the adhesive is a single component adhesive.

8. The pressing device according to claim 1, wherein the support part (6; 6'; 6"; 6'") is an integrally molded plastic part, which consists of a plastic material.

9. The pressing device according to claim 1, wherein the pressing surface (2) is formed by a wall section (10) of the mass body (M1; M2).

10. The pressing device according to claim 1, wherein the mass body (M1; M2) has a height (H) and the support part (6; 6'; 6"; 6'") has a length (L), wherein the length (L) and the height (H) is in a ratio of between 1 to 1.2 and 1 to 3.

* * * * *